United States Patent [19]

Barton, deceased

[11] 4,000,535

[45] Jan. 4, 1977

[54] SHOE MACHINE SHOE SIZE AND SIDE SENSING ARRANGEMENTS

[75] Inventor: George Clifford Barton, deceased, late of Leicester, England, by Margaret Ellen Barton, executrix

[73] Assignee: USM Corporation, Boston, Mass.

[22] Filed: June 5, 1975

[21] Appl. No.: 583,951

[30] Foreign Application Priority Data

June 5, 1974 United Kingdom ..... 24866/74

[52] U.S. Cl. ..... 12/126; 12/8.3

[51] Int. Cl.[2] ..... A43D 3/00; A43D 23/00

[58] Field of Search ..... 12/126, 127, 123, 8.3, 12/1 R, 1 A

[56] References Cited

UNITED STATES PATENTS

| | | | |
|---|---|---|---|
| 3,107,376 | 10/1963 | Reid et al. | 12/1 R |
| 3,849,817 | 11/1974 | Berrill et al. | 12/8.3 |

*Primary Examiner*—Patrick D. Lawson

*Attorney, Agent, or Firm*—Donald N. Halgren; Richard B. Megley; Vincent A. White

[57] ABSTRACT

A shoe sensing mechanism for setting a machine according to the size of a shoe and whether the shoe to be worked on is left or right.

5 Claims, 3 Drawing Figures

SHOE MACHINE SHOE SIZE AND SIDE SENSING ARRANGEMENTS

BACKGROUND OF THE INVENTION

1. FIELD OF THE INVENTION

This invention relates generally to shoe manufacturing machinery and, more particularly, to sensing mechanisms for determining whether a left or a right shoe is presented to the machine.

2. DESCRIPTION OF THE PRIOR ART

In the manufacture of shoes, various arrangements have been devised to determine whether a shoe is left or right, and to measure shoe size and have the shoe machinery adjusted to differing sizes. A machine with such capabilities is described in U.S. Pat. No. 3,849,817 and assigned to the assignee of the present invention. The machine has however a rather complicated shoe sensing side clamp arrangement. Other shoe machines in the prior art require that they be loaded only with one particular side of shoe or the other, by a discriminating operator.

It is an object of this invention to provide a relatively simple shoe size and side gauging arrangement for a shoe manufacturing machine, permitting less skilled and, hence, less expensive operation.

SUMMARY OF THE INVENTION

The present invention provides, in accordance with the features thereof, a shoe assembly positioning mechanism for use with a machine for operating on the shoe. The positioning mechanism includes a shoe supporting means having a last engaging member for supporting a heel end portion of the last of a shoe assembly, and a shoe positioning or aligning means.

The shoe aligning means comprises a pair of side gauges arranged to engage forepart regions of the shoe assembly at opposite sides thereof. Means for sequentially moving the side gauges into operative positions wherein a first side gauge is moved to an operative position with engagement of an outside joint portion of the shoe assembly, for example, a left side shoe assembly. The shoe assembly being in alignment with a center line of the machine, the remaining side gauge is moved to shoe engaging position to hold the shoe assembly in position determined by the first side gauge.

Sensing means are provided to determine if the shoe assembly is correctly positioned, and, if not, for bringing about an appropriate change in the positional arrangement of the side gauges.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
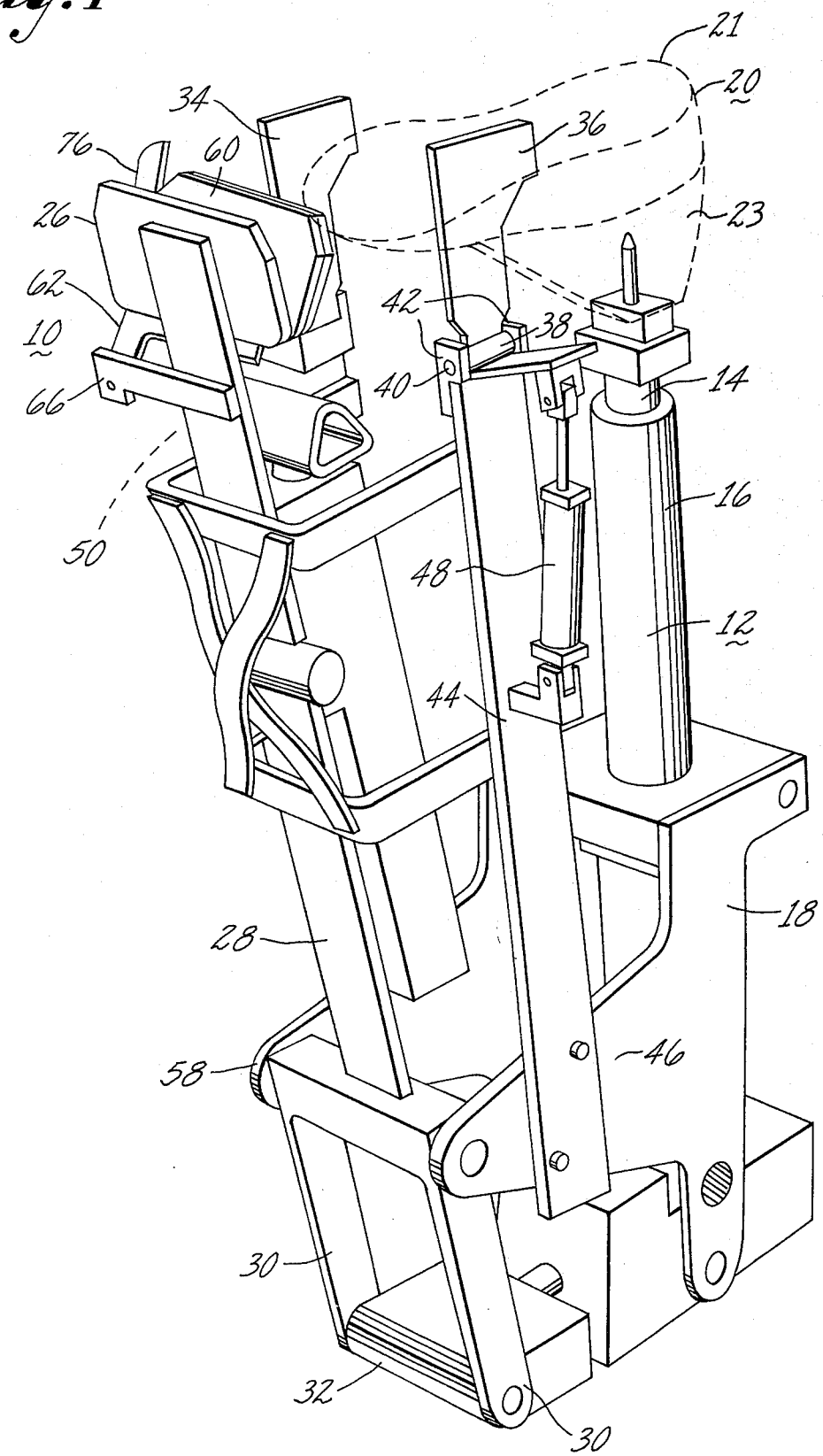
FIG. 1 is a perspective view of a portion of an illustrative machine showing the side gauges, toe plates and sensor arrangement.

Referring to the drawings and, more particularly, to FIG. 1, there is shown a shoe positioning mechanism 10 including a shoe supporting arrangement 12. The shoe supporting means comprises a jack post 14 which is slidable in a sleeve member 16 which is fixed between a pair of plate members 18 pivotally supported between side plates of a carriage, not shown. The shoe supporting means is movable lengthwise of a shoe assembly 20 comprising an upper 21 and a last 23 carried by the jack post 14, to effect relative movement between the shoe assembly 20 and operating means such as adhesive applying nozzles and lasting instrumentalities, not shown, but which may otherwise be included on the machine.

Figure 2:
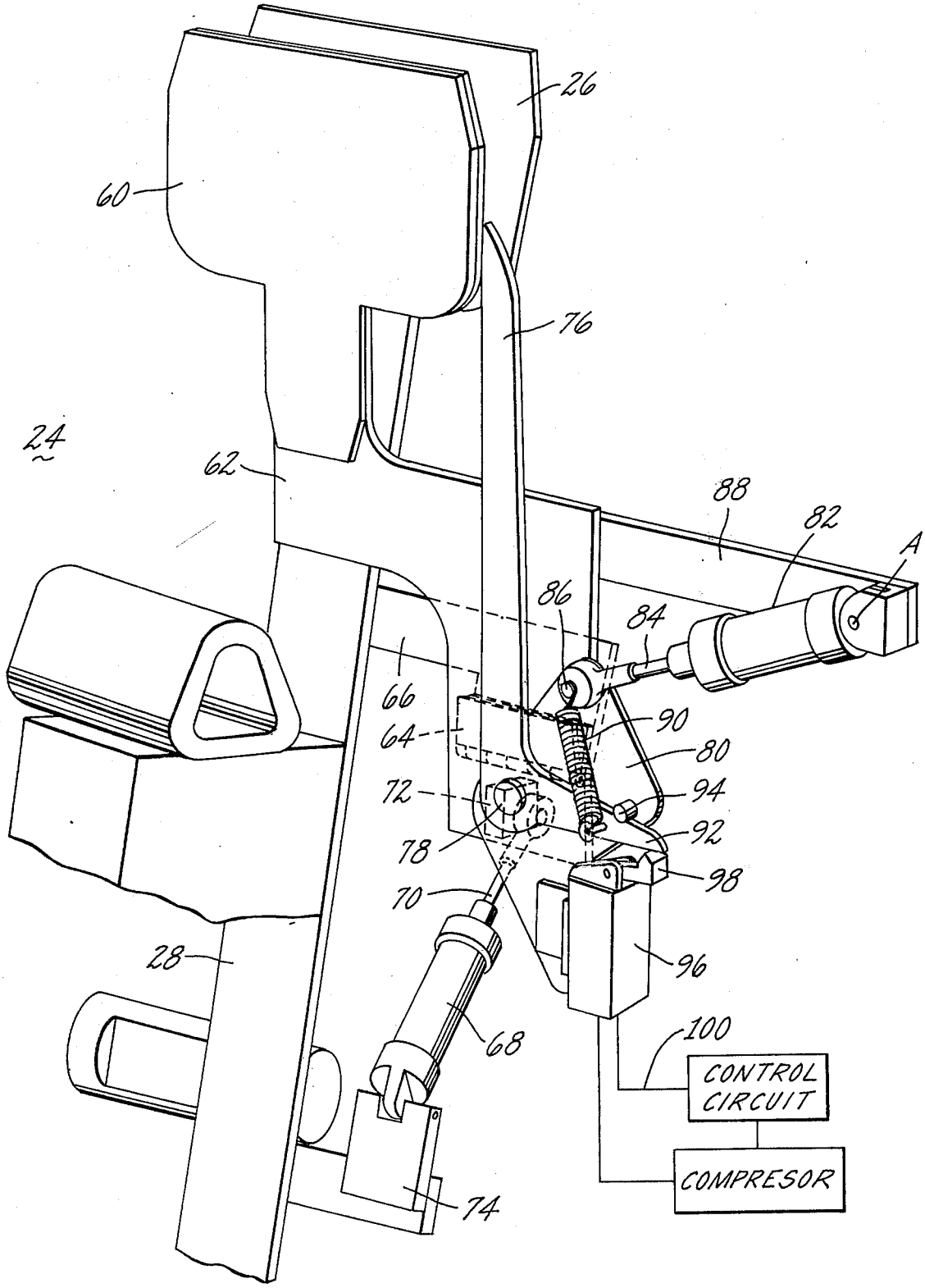
FIG. 2 is a perspective view, as seen from the rear, of the toe plates and sensor arrangement.

The shoe positioning mechanism 10 also comprises a shoe length measuring device 24 shown more clearly in FIG. 2. The measuring device 24 includes a plate 26 which is mounted upon an upper end portion of an arm 28 of a two-armed lever 30 which is pivoted on a carriage 32 and is movable to carry the plate 26 toward and away from the toe end portion of the shoe assembly 20 supported on the jack post 14.

The shoe positioning mechanism 10 also includes a pair of side gauges 34 and 36 in the form of plates connected at their lower ends to blocks 38 which are each pivoted on a pin 40 extending lengthwise with respect to the shoe assembly 20 carried by the jack post 14. The pins 40 extend between a pair of brackets 42 which are secured to upper end portions of a pair of side frame members 44, lower end portions of each being secured to an arm 46 of the plate 18 supporting the jack post carrying the sleeve member 16. The side gauges 34 and 36 are movable to shoe engaging positions by means of piston and cylinder devices 48 and 50.

The illustrative machine also includes an auxiliary toe engaging plate 60 shown more clearly in FIG. 2. The auxiliary toe engaging plate 60 extends upwardly from a supporting member 62 attached to a bracket 66 by a hinge 64. The bracket 66 extends sideways from the arm 28, as shown in FIG. 2. The auxiliary toe engaging plate 60 is therefore mounted for movement relative to the arm 28 and the plate 26 toward and away from the toe end portion of the shoe assembly 20 supported in the machine. The plate 60 is moved by a piston and cylinder device 68 which has a piston rod 70. The piston rod 70 is pivotally connected to a block 72 which is secured to the supporting member 62. The cylinder of the device 68 is pivotally supported on a bracket 74 secured to the arm 28.

A sensor comprising a finger 76 extends upwardly from and is pivoted on a pin 78 which extends generally lengthwise of the shoe assembly 20 from the supporting member 62. An actuating member 80 is also pivoted on the pin 78, the actuating member being in the form of a plate shaped as shown in FIG. 2. A piston and cylinder device 82 has a piston rod 84 connected, by a pin 86, to one portion of the actuating member 80. The device 82 is used to swing the actuating member 80 about the pin 78. The cylinder of the device 82 is pivotally connected, at A, to a bar 88 extending sideways from the supporting member 62. An arm 92 extending outwardly from the finger 76 holds one end of a tension spring 90 which extends between the pin 86 and a hook carried thereon. The spring 90 acts normally to hold the arm 92 in engagement with a stop pin 94 extending from the actuating member 80. The finger 76 is located so that, on operation of the piston and cylinder device 82, it swings widthwise of a shoe assembly supported in the machine at a locality just behind (as seen from the front of the machine) the auxiliary toe engaging plate 60.

A switch device 96, conveniently in the form of a microswitch or valve, is mounted upon a depending portion of the actuating member 80. The switch device 96 is provided with an actuator 98 positioned just below the arm 92. The switch device 96 is connected in a control circuit arrangement 100 of the machine which is arranged to supply the piston and cylinder devices 48, 50 with fluid under pressure, conveniently compressed air.

Figure 3:
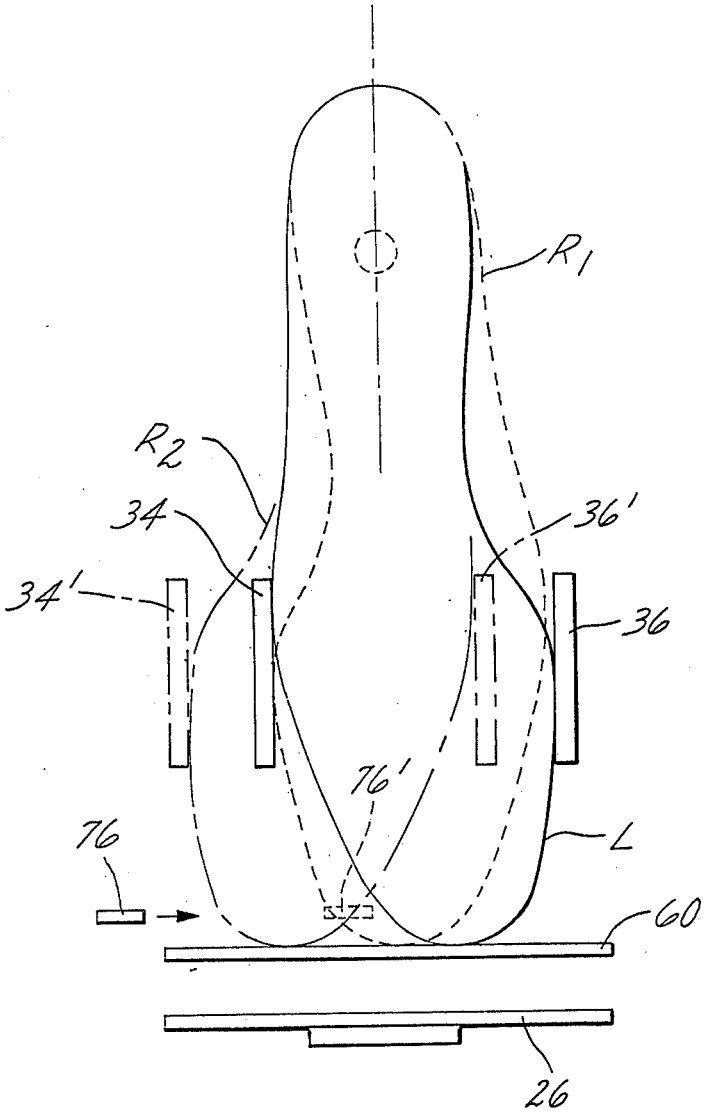
FIG. 3 is a diagrammatic view showing how side gauges of the machine operate to position a shoe assembly in correct alignment in the machine.

The operation of the side gauges will now be described to include FIG. 3 of the accompanying drawings. The control circuit arrangement 100 of the machine is so arranged that initially the cylinder of the piston and cylinder device 48 associated with the side gauge 36 is supplied with air at relatively high pressure to hold the side gauge 36 in operative position in engagement with the outside joint region of a shoe assembly for a left foot. This action positions that shoe assembly in correct alignment with respect to the center line of the machine (which center line passes through the last supporting pin of the shoe supporting jack). The full line L in FIG. 3 shows the outline of a shoe assembly so positioned. The piston and cylinder device 50 associated with the side gauge 34 is then supplied with air under comparatively low pressure to move the side gauge 34 into shoe engaging position to hold the shoe assembly in operative position as determined by the side gauge 36.

The piston and cylinder device 68 is then supplied with air under pressure to swing the supporting member 62 in a direction relative to the arm 28 to carry the auxiliary toe engaging plate 60 into engagement with the toe end of the shoe assembly. Air, or other appropriate fluid, under pressure, is then supplied to the piston and cylinder device 82 to swing the actuating member 80 about the pin 78 in a direction to carry the finger 76 yieldably (under action of the spring 90) toward the side of the toe end portion of the shoe assembly. The stroke of the piston rod 84 is so determined (as by a suitable stop arrangement) that the finger 76 moves to a position shown in dotted lines (76' shown in FIG. 3) which does not contact the shoe assembly.

If, however, a shoe assembly for a right foot is positioned on the last pin with the inside joint region positioned against the side gauge 36 the bottom of the shoe assembly will occupy a position as indicated, in outline, by the dashed line $R_1$ shown in FIG. 3. When the side gauge 36 is moved, at relatively low pressure, into shoe engaging position the shoe assembly is positioned, as shown by the line $R_1$ in FIG. 3, so that when the finger 76 moves toward its position 76' it engages a toe end portion of the shoe assembly and causes the finger 76 and the arm 92 to be swung about the pivot pin 78 to actuate the switch device 96. Actuation of the switch brings about a change in the control circuit arrangement 100 whereby the cylinder 48 is supplied with air at comparatively low pressure while the cylinder 50 is supplied with air at relatively high pressure. This switching of the air supply to the cylinders 48, 50 moves the side gauges 36 and 34 respectively into the positions indicated in outline at 36' and 34' in FIG. 3, thus positioning the shoe assembly for a right foot with its bottom in the position indicated by the chain-dotted line $R_2$. In this position the shoe assembly for a right foot is correctly aligned with respect to the center line of the machine.

With the shoe assembly correctly aligned the arm 28 may then be swung to carry the plate 26 into engagement with the plate 60 to effect shoe length measurement.

The shoe size and side sensing arrangement described above permits manufacture of varying shoe lengths and alternating shoe sides in a single machine. The sensors are not complicated in their manufacture or maintenance, and their use in a shoe upper conforming machine permits less skilled and hence less expensive operation.

While the machine has been described with a certain degree of particularity, it is to be understood that the previous description is exemplary only and that the scope of the invention is defined by the following claims.

I claim:

1. A machine for lasting shoes, including:

a shoe assembly supporting arrangement;

a last engaging member for supporting a heel end portion to a last;

a shoe assembly aligning arrangement comprising at least two gauges, one on each side of said shoe, said gauges being movable toward and away from the sides of said shoe assembly comprising means for moving said shoe assembly upon a signal from a movable sensor; and means for moving said shoe assembly alignment arrangement in a sequential manner;

said movable sensor comprising a pivotal finger member connected with a control circuit movable about an axis on an actuating member, said pivotal member having means for activating a circuit control switch.

2. A machine for lasting shoes as recited in claim 1, wherein said pivotal member having an extension thereon for activating said switch governing said control circuit which motivates said gauges through an arrangement of pressurizable cylinders on each side of said shoe assembly.

3. A machine for lasting shoes as recited in claim 1, including:

a first toe engaging plate;

an auxiliary toe engaging plate hingedly attached to a bracket member disposed on a support member of said first toe engaging plate;

said auxiliary toe engaging plate being arcuately movable between said first toe engaging plate and the front of said shoe assembly.

4. A machine for lasting shoes as recited in claim 2, wherein said switch comprises a valve capable of variably regulating pressurizable fluid to said cylinders that motivate said gauges.

5. A machine for lasting shoes as recited in claim 3, wherein said auxiliary toe engaging plate has a pressurizable cylinder attached between said support member and said auxiliary toe engaging plate, said pressurizable cylinder permitting enough movement of said auxiliary toe engaging plate to lightly engage the front of said shoe assembly;

said first toe engaging plate being pivotal to swing into engagement with said auxiliary toe engaging plate to permit meansurement of said shoe assembly.

* * * * *

PO-1050
(5/69)

UNITED STATES PATENT OFFICE

CERTIFICATE OF CORRECTION

Patent No. 4,000,535 Dated January 4, 1977

Inventor(s) George Clifford Barton

It is certified that error appears in the above-identified patent and that said Letters Patent are hereby corrected as shown below:

Column 4, Cl. 2, Line 40, delete "which"

Signed and Sealed this

Twenty-second Day of March 1977

[SEAL]

*Attest:*

RUTH C. MASON
*Attesting Officer*

C. MARSHALL DANN
*Commissioner of Patents and Trademarks*